US007080736B2

(12) United States Patent
Jackson et al.

(10) Patent No.: US 7,080,736 B2
(45) Date of Patent: Jul. 25, 2006

(54) EASILY DISPLAYABLE SHIPPING CONTAINER

(75) Inventors: Keith A. Jackson, Gurnee, IL (US); Joseph P. Schomisch, East Troy, WI (US)

(73) Assignee: Packaging Corporation of America, Lake Forest, IL (US)

( * ) Notice: Subject to any disclaimer, the term of this patent is extended or adjusted under 35 U.S.C. 154(b) by 144 days.

(21) Appl. No.: 10/397,077

(22) Filed: Mar. 26, 2003

(65) Prior Publication Data

US 2003/0226783 A1 Dec. 11, 2003

Related U.S. Application Data

(60) Provisional application No. 60/367,568, filed on Mar. 26, 2002.

(51) Int. Cl.
*B65D 75/58* (2006.01)

(52) U.S. Cl. ..... 206/738; 206/774; 229/122; 229/164; 229/240

(58) Field of Classification Search ..... 206/736, 206/738, 746, 774; 229/240, 241, 122, 164
See application file for complete search history.

(56) References Cited

U.S. PATENT DOCUMENTS

| | | | |
|---|---|---|---|
| 1,186,920 | A | 6/1916 | Ledbetter |
| 1,649,211 | A | 11/1927 | Bitzer |
| 2,018,707 | A | 10/1935 | Daller |
| 2,450,035 | A | 9/1948 | De Mian |
| 2,797,040 | A | 6/1957 | Belsinger |
| 2,942,770 | A | 6/1960 | Eichorn |
| 2,955,734 | A | 10/1960 | Barton |
| 2,983,424 | A | 5/1961 | Glass |
| 3,079,058 | A | 2/1963 | Russell |
| 3,111,254 | A | 11/1963 | Thyen |
| 3,241,737 | A | 3/1966 | Steinbock |
| 3,533,549 | A | 10/1970 | Gilchrist |
| 3,669,341 | A | 6/1972 | Hughes |
| 3,820,706 | A | 6/1974 | Gibson et al. |
| 3,863,829 | A | 2/1975 | Merrill |

(Continued)

FOREIGN PATENT DOCUMENTS

EP 0529260 A2 7/1992

(Continued)

OTHER PUBLICATIONS

PCT Search Report for International Application PCT/US02/20819 dated Sep. 13, 2002.

(Continued)

*Primary Examiner*—Luan K. Bui
(74) *Attorney, Agent, or Firm*—Jenkens & Gilchrist

(57) ABSTRACT

A container for distribution and display of goods is convertible from a first configuration for distribution into a second configuration for display. The conversion is accomplished by removing a front cover panel. The front cover panel may be attached to the container using a variety of methods, including a perforated score line, a tear-away strip, adhesives, tapes, or a combination of these methods. When the front cover panel is removed for retail display, an access opening is uncovered, allowing users to easily view and access the contents of the container. The front cover panel may further cover graphics and text provided along the front of the container so that the graphics and text are not marred or otherwise damaged during distribution. In addition, the front cover panel may be provided with distribution information thereon, which is unimportant to an end user such as a retail customer and is easily removed for display of the container.

12 Claims, 6 Drawing Sheets

U.S. PATENT DOCUMENTS 3,863,831 A 2/1975 Wozniacki et al.
3,871,570 A 3/1975 Garmon
3,881,648 A 5/1975 Hall
3,910,484 A 10/1975 Wozniacki
3,940,053 A 2/1976 Putman et al.
3,961,706 A 6/1976 Roccaforte et al.
4,053,098 A 10/1977 Baptist
4,053,100 A 10/1977 Baptist
4,053,101 A 10/1977 Hart, Jr.
4,082,215 A 4/1978 Eichenauer
4,101,048 A 7/1978 Rieben et al.
4,103,819 A 8/1978 Muise
4,117,929 A 10/1978 VanderMey
4,121,753 A 10/1978 Westfall
4,151,948 A 5/1979 de la Fuente, Jr.
4,170,297 A 10/1979 Johnson
4,171,762 A 10/1979 Matthews
4,175,691 A 11/1979 Cornell et al.
4,185,741 A 1/1980 Schiff et al.
4,191,288 A 3/1980 Hostad
4,228,898 A 10/1980 Zeitter et al.
4,234,081 A 11/1980 Champlin
4,284,195 A 8/1981 Champlin
4,291,830 A 9/1981 Sorensen
4,300,680 A 11/1981 Champlin
4,304,351 A 12/1981 Stollberg
4,318,474 A 3/1982 Hasegawa
4,324,328 A 4/1982 Champlin
4,335,843 A 6/1982 Kent
4,347,969 A 9/1982 Kost et al.
4,349,147 A 9/1982 Jensen
4,350,281 A 9/1982 Dornbusch et al.
4,382,504 A 5/1983 Vesborg
4,385,721 A 5/1983 Olsen et al.
4,391,405 A 7/1983 Drinon
4,394,905 A 7/1983 Hackenberg
4,418,863 A 12/1983 Kimbrell, Sr.
4,441,649 A 4/1984 Nederveld
4,511,080 A 4/1985 Madsen et al.
4,537,344 A 8/1985 Thomas
4,542,847 A 9/1985 Lindstrom
4,565,316 A 1/1986 Jes
4,567,996 A 2/1986 Muise
4,570,790 A 2/1986 Turnage
4,600,142 A 7/1986 Quaintance
4,613,045 A 9/1986 Watson
4,645,122 A 2/1987 Nederveld
4,676,429 A 6/1987 Crowe et al.
4,753,341 A 6/1988 McIntyre
4,770,339 A 9/1988 Weimer
4,787,515 A 11/1988 Stoll
4,852,756 A 8/1989 Holladay
4,866,232 A 9/1989 Stone
4,871,067 A 10/1989 Valenti
4,883,221 A 11/1989 Brundage
4,884,739 A 12/1989 Nederveld
4,884,741 A 12/1989 Nederveld
4,946,093 A 8/1990 Moorman
4,949,898 A 8/1990 Nederveld
4,958,734 A 9/1990 Wood et al.
4,969,559 A 11/1990 Nederveld
5,000,377 A 3/1991 McClure
5,002,224 A 3/1991 Muise
5,035,330 A 7/1991 Kuchenbecker
5,052,615 A 10/1991 Ott et al.
5,106,013 A 4/1992 Southwell et al.
5,125,567 A 6/1992 McClure
5,139,196 A 8/1992 Fry et al.
5,163,609 A 11/1992 Muise, Jr.
5,261,594 A 11/1993 Brown et al.
5,263,612 A 11/1993 Nederveld
5,277,360 A 1/1994 DeMott
5,285,731 A 2/1994 McIntyre
5,285,956 A 2/1994 Piepho
5,289,970 A 3/1994 McClure
5,294,044 A 3/1994 Clark
5,330,094 A 7/1994 Mertz
5,350,111 A 9/1994 Vosbikian
5,361,975 A 11/1994 Droste et al.
5,361,976 A 11/1994 Blomfield
5,370,303 A 12/1994 Fry
5,386,937 A 2/1995 Crawford
5,392,985 A 2/1995 Smith et al.
5,413,276 A 5/1995 Sheffer
5,429,296 A 7/1995 Southwell et al.
5,458,272 A 10/1995 Ward-Weber
5,458,283 A 10/1995 Southwell et al.
5,516,034 A 5/1996 Jensen et al.
5,524,815 A 6/1996 Sheffer
5,535,941 A 7/1996 Garza
5,622,309 A 4/1997 Matsuda et al.
5,649,663 A 7/1997 Pestow, Jr.
5,657,872 A 8/1997 Leftwich et al.
5,673,848 A 10/1997 Garza
5,687,902 A 11/1997 Tusing et al.
5,704,193 A 1/1998 Roe et al.
5,729,960 A 3/1998 Davis
5,860,590 A 1/1999 Blomfield et al.
5,938,108 A 8/1999 Williams et al.
5,941,452 A 8/1999 Williams et al.
5,950,914 A 9/1999 Dunton et al.
5,957,294 A 9/1999 Kanter
6,047,646 A 4/2000 Gugel
6,168,027 B1 * 1/2001 Esser ..... 206/738
6,189,778 B1 2/2001 Kanter
6,189,780 B1 2/2001 Kanter
6,223,978 B1 5/2001 Drager
6,286,753 B1 9/2001 Jackson et al.
6,302,323 B1 10/2001 Southwell
6,375,068 B1 4/2002 Jackson et al.
6,481,619 B1 11/2002 Jackson
6,581,772 B1 6/2003 Noland
2003/0010816 A1 1/2003 Jackson

FOREIGN PATENT DOCUMENTS

FR 2728867 12/1994
GB 2245542 A 1/1992
JP 10-310130 11/1998
WO WO 99/43560 9/1999

OTHER PUBLICATIONS

PCT Search Report for International Application PCT/US03/09454 dated Mar. 26, 2003.
Abstract for EP 0529260 A2 (see B01 above).
Abstract for FR 2,728,867 A1 (see B02 above).
Abstract JP 10-310130 (see B03 above).

* cited by examiner

EASILY DISPLAYABLE SHIPPING CONTAINER

CROSS-REFERENCE TO RELATED APPLICATION

This application claims the benefit of U.S. Provisional Patent Application Ser. No. 60/367,568, filed Mar. 26, 2002.

FIELD OF THE INVENTION

The present invention relates generally to containers for retaining, protecting and displaying goods and methods for making such containers. In particular, the present invention relates to a shipping container which is easily converted into a container suitable for product display.

BACKGROUND OF THE INVENTION

Flat sheets of corrugated paperboard, typically referred to as blanks, have been used for many years as the starting material to form containers. Corrugated paperboard generally refers to a multi-layer sheet material comprised of two sheets of liner bonded to a central corrugated layer of medium. Given a basic size requirement specified by the customer, industry standards, and the preference for low cost, paperboard container manufacturers strive to provide structural stacking strength with a minimal amount of corrugated paperboard. A typical well-known container is a single-piece tray design having a bottom wall, two side walls and two end walls each hinged to the bottom wall. Typically, a single piece of corrugated paperboard will be cut and scored to form a flat blank that will then be erected into this container.

In shipping and displaying goods, particularly in a retail setting, it is desirable to have a container which is easy to pack, sturdy and fully enclosed for protection of contents during storage and shipping, and also suitable for display at a retail site. For example, it is beneficial to have a container which allows a customer at a retail site to easily reach into the container and remove products for purchase. In such an application, it is desirable to have a printed area on the container which advertises or identifies the product. During storage and shipment of a container, it is important that a printed area be protected so that it remains attractive to the consumer at the retail location. Of course, the access opening through which a consumer can access the goods must also be closed during shipment and storage to prevent spilling of the product out of the container. One solution that has been proposed involves the use of a separate half slotted container or "dust cover" that is placed over the primary tray or container. This dust cover helps to contain the product and provides protection to the retail package's outer surface, but a separate cover tends to add cost to a packaging system by means of additional material, more material handling, and more material to dispose of at the retail site.

There have been attempts in the past to manufacture a one-piece displayable container using perforated tear out panels, but these approaches have encountered several problems. For example, the perforations in previous attempts at such a design are generally unprotected and located in areas that are highly susceptible to damage during shipping. This susceptibility to damage has led to premature failure of the perforations or has resulted in the use of stronger perforations requiring excessive force or tools to open. Further, a perforated window, in itself, does not provide protection to any outside surfaces of a container, resulting in the potential for unattractive packages at retail sites due to gouges or scuffing from the distribution environment. Other attempts at creating a useful one-piece displayable container have used complex geometric designs requiring special equipment to manufacture, erect, and fill.

Thus, it is desirable to provide a container for the transporting and display of goods which can be easily manufactured on standard manufacturing and erecting equipment, and which further provides for easy alteration for display at retail and for convenient consumer access to the container contents. It is further desirable to allow for the easy removal of container shipment-related markings which have no importance to retail consumers.

SUMMARY OF THE INVENTION

According to one embodiment of the present invention, a container is provided which allows for protection of contents during shipment and further provides for easy conversion into a retail display configuration.

According to another embodiment of the present invention, a shipping container is provided with a protective panel which extends over an access opening and further extends over marketing graphics during shipment. The protective panel is easily removed at retail sites for display of marketing graphics and for access to the contents of the container.

BRIEF DESCRIPTION OF THE DRAWINGS

Other objects and advantages of the invention will become apparent upon reading the following detailed description and upon reference to the drawings in which.

Figure 1:
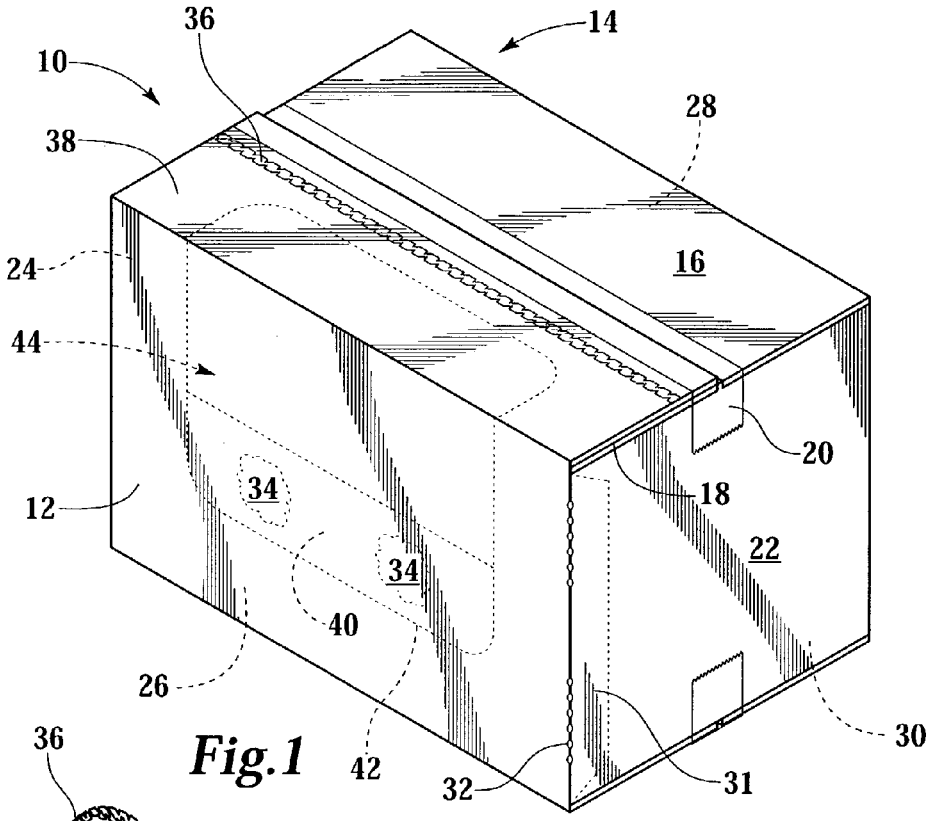
FIG. 1 is an isometric view of a shipping and display container according to one embodiment of the present invention.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Turning now to FIG. 1, a container 10 according to the present invention is shown. The container 10 is adapted for protection of the container's contents during shipping and storage and for easy conversion of the container 10 from a shipping and storage configuration to a display configuration. To facilitate the transformation between configurations for shipping and display, the container 10 is provided with a front cover panel 12. As is further explained below, the front cover panel 12 may also be considered a "fifth panel" as it constitutes an additional panel not found in standard four-panel container construction.

According to one embodiment of the present invention, the container 10 further comprises a top 14, including first and second outer top flaps 16 and 18, which may be held closed by tape 20 or other suitable sealing means. Several configurations are available for closing a container 10 according to the present invention. In the embodiment shown in FIG. 1, the second outer top flap 18 is beneath a top portion of a front cover panel, described in more detail below. In other embodiments, either the second outer top flap 18 or the top portion of a front cover panel may be omitted from the container 10. The container 10 further comprises first and second side panels 22 and 24, a front panel 26, a back panel 28, and a bottom 30. Though the container 10 will be described in these terms, it is to be understood that the dimensions of a container according to the present invention can be designed to allow a number of panel configurations, such that a front panel may be provided with smaller dimensions than a side panel, for example. In one embodiment, during construction of the container 10, the front panel 26 is attached to the first side panel 22 along a manufacturing tab 31 which is glued to the first side panel 22.

According to one embodiment of the present invention, the front cover panel 12 is attached along a cover panel perforated score 32 to another panel of the container 10. In the embodiment shown in FIG. 1, the front cover panel 12 is attached along the cover panel perforated score 32 to the second side panel 22. It is preferred but not required that the front cover panel 12 cover the front panel 26. It may be advantageous to cover only a portion of the front panel 26, for example in applications where there are no graphics or text to be protected on the front panel 26. The perforated score 32, along with other perforations used in the present invention, may be perforated along its entire length, or it may be perforated only at portions, and it may include gaps between perforated segments. According to one embodiment, the perforated score 32 comprises two perforated areas having 3/16" perforations with 1/8" skips between perforations. Alternatively, the perforated score 32 may be replaced with a standard score, such that the front cover panel 12 is more easily destructively removed by ripping off, or cutting with a utility knife, for example.

In another embodiment of the present invention, the manufacturing tab 31 may be extended some distance over the inside of the first side panel 22. In this embodiment, the cover panel perforation score 32 may be replaced with a standard non-perforated score line, and the front cover panel 12 may be attached to the first side panel 22 along a vertical tear strip or zipper strip (not shown) provided along the first side panel 22. In this embodiment, after the tear strip is removed, a portion of the manufacturing tab is visible on the outside of the container 10. Likewise, in a similar embodiment, a vertical tear or zipper strip may be located on the front cover panel 12 itself. It is to be understood that these and other attachment means may be used to attach the front cover panel to one or both side panels of the container 10 such that the front cover panel 12 is easily released either along or in proximity to the line of attachment to one or both side panels.

Figure 2:
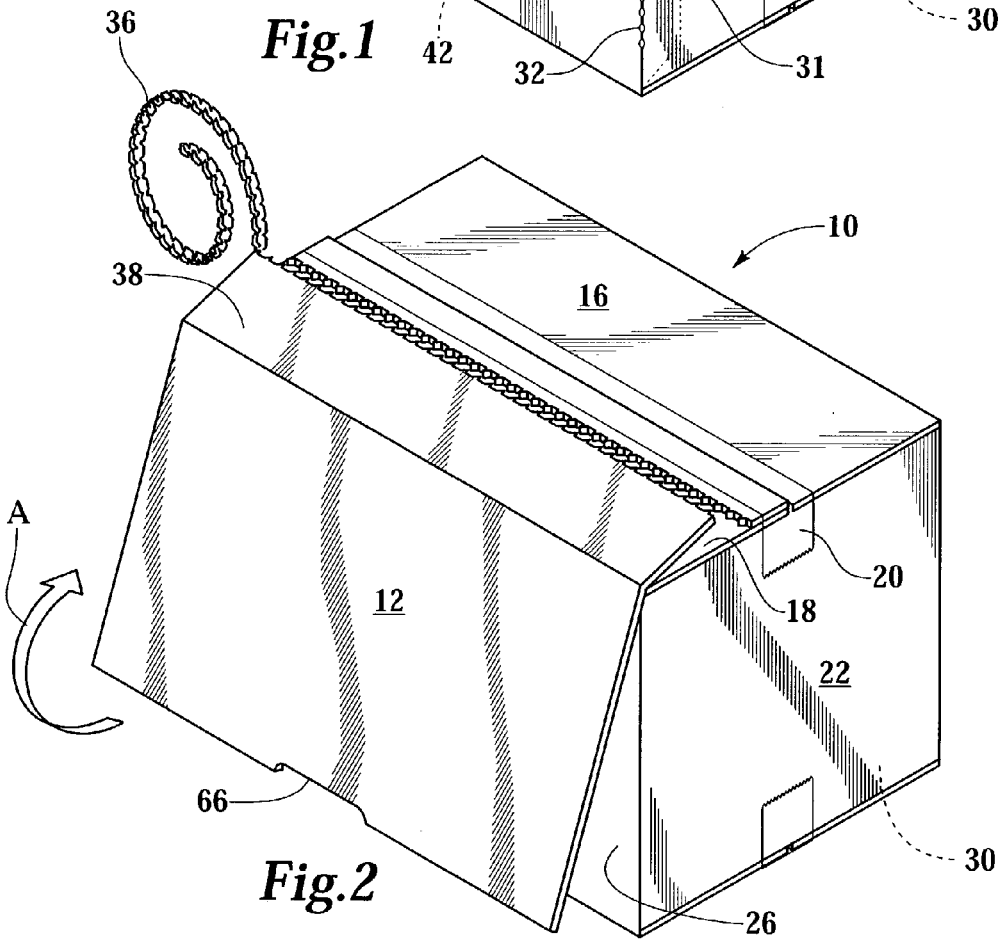
FIG. 2 is an isometric view of the shipping and display container of FIG. 1 in the process of being converted for display of the container's contents.
Figure 3:
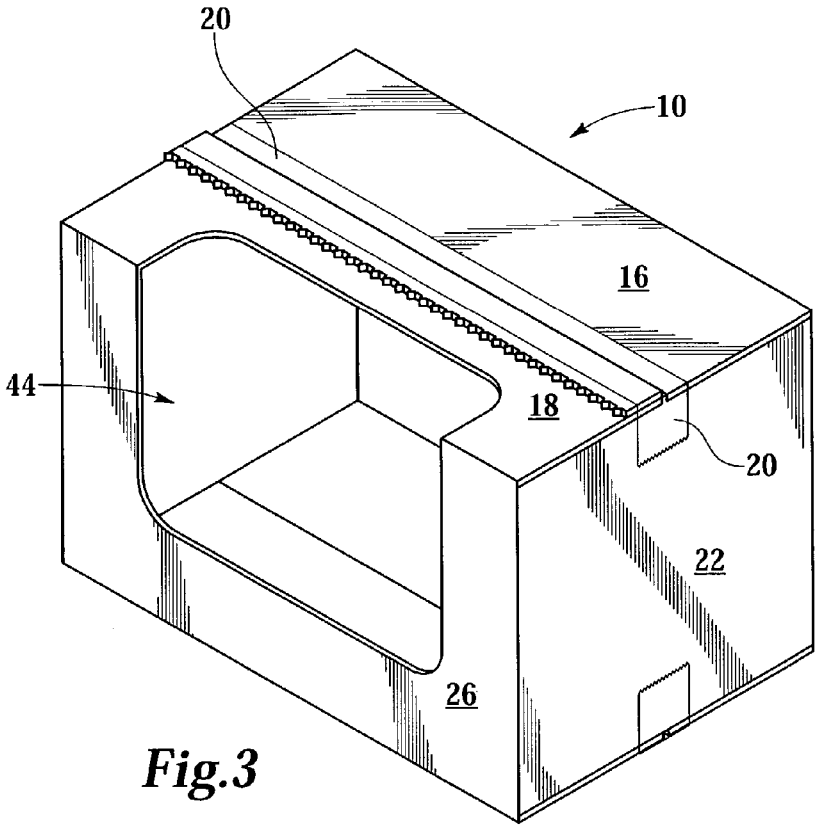
FIG. 3 is an isometric view of the shipping and display container of FIG. 1 in a display configuration.

The front cover panel 12 is further attached to the remainder of the container 10 through the use of adhesive areas 34 and a tear-away strip 36. Alternatively, the tear-away strip 36 may be omitted and the front cover panel 12 may remain attached to the container by the tape 20 or by adhesive or other connection means. The tear-away strip serves primarily to ease removal of the front cover panel 12. To convert the container 10 shown in FIG. 1 into a display configuration, a user removes a tear-away strip 36, thereby freeing a top portion 38 of the front cover panel 12, as shown in FIG. 2. The front cover panel 12 is thus still attached to the front panel 26 by a punch-out portion 40. The punch-out portion 40 is attached to the remainder of the front panel 26 along a perforated punch-out path 42. The user further removes the front cover panel by grasping it along a bottom edge and pulling outwardly, in the direction shown by arrow "A" in FIG. 2. To ease removal, the front cover panel 12 may be provided with a front cover panel handle cutaway 66. Pulling the front cover panel 12 causes the removal of the punch-out portion 40 from the container 10, with the punch-out portion 40 remaining attached to the front cover panel 12. Further, pulling the front cover panel 12 causes the cover panel perforated score 32 to rupture. It is to be understood that the front cover panel 12 may also be removed by first pulling the front cover panel 12 from the bottom and later removing the tear-away strip 36. Following removal of the front cover panel 12, an access opening 44 through which a user may grasp the contents of the container 10 is exposed, as shown in FIG. 3. The retailer is left with a simple form of waste from this procedure—a flat paperboard panel which is easily disposed of or recycled.

Figure 7:
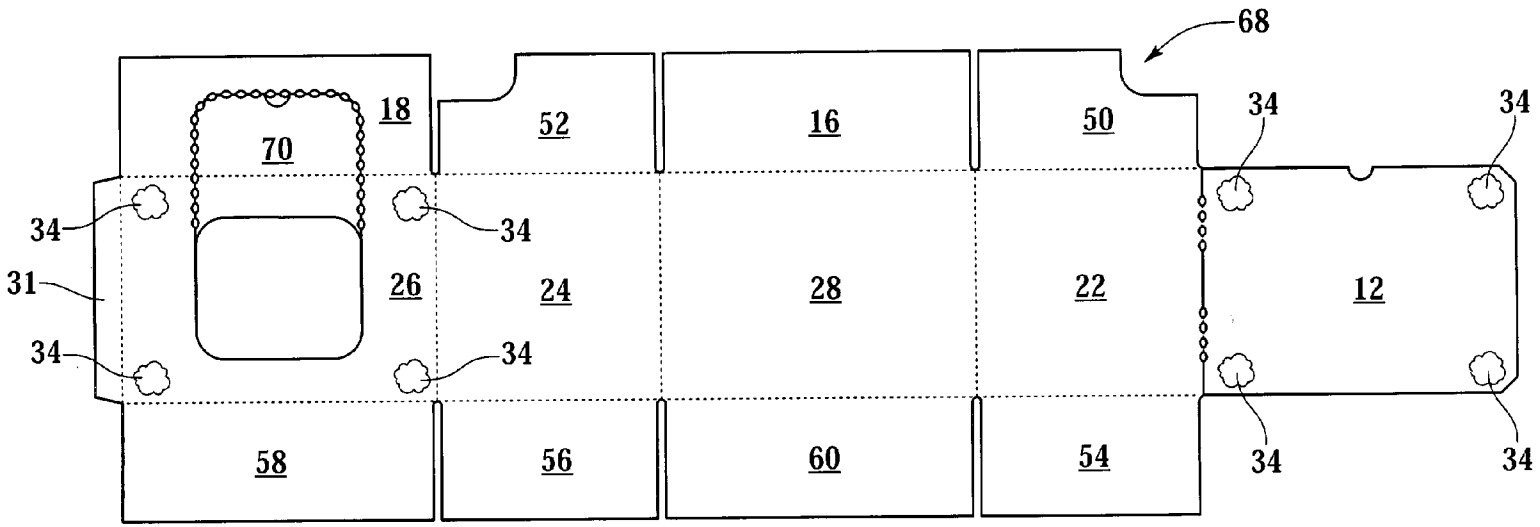
FIG. 7 is a plan view of the inner surface of an alternative blank for forming one embodiment of a stackable, displayable container according to the present invention.

The container 10 of FIG. 1 may be constructed such that the second outer top flap 18 extends inwardly along the top 14 of the container farther than the top portion 38 of the front cover panel 12 extends. This embodiment allows attachment means, such as the tape 20, to contact at least a portion of three surfaces: the top portion 38 of the front cover panel 12, a segment of the second outer top flap 18, and the first outer top flap 16. The innermost of these flaps may be connected to inner top flaps, discussed below, using adhesives or mechanical connectors such as staples to further affect closure of the container 10, and such methods may be used in addition to or instead of connections among the outermost flaps or portions. Further, it is preferred in some embodiments to provide adhesive areas 34 toward corners of the front cover panel 12 to make it more difficult for the front cover panel 12 to be accidentally removed or deformed during distribution of a container 10. Such a location for the adhesive areas 34 is more clearly illustrated in the plan view of FIG. 7. It is preferred that the adhesive areas 34 be provided on an outside surface of the front panel 26 or on an inside surface of the front cover panel 12.

Figure 4:
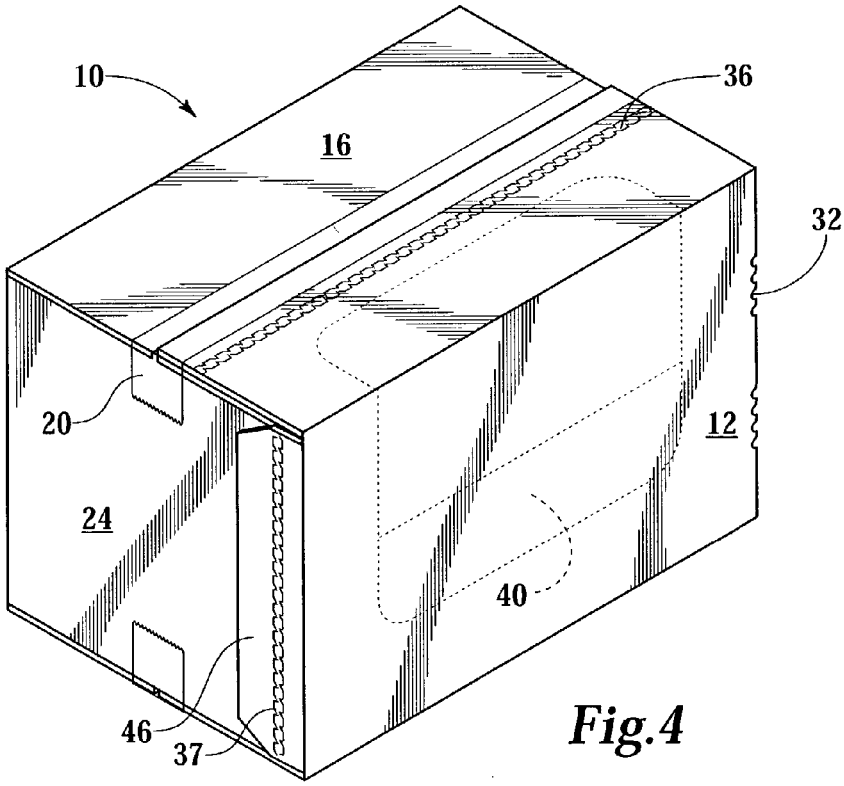
FIG. 4 is an isometric view of a shipping and display container according to one embodiment of the present invention.

FIG. 4 displays an alternative method for attaching a front cover panel 12 to a container 10. In the embodiment of FIG. 4, a side tear-away strip 37 placed on a side cover attachment flap 46 is adapted to be torn open during conversion of the container from a shipping and storage configuration to a display configuration. The side cover attachment flap may be adhered to the side panel 24 using tape, glue, or another suitable attachment means such as staples. Thus, the front cover panel 12 is attached by at least three points to the container: two tear-away strips 36 and 37 and a cover panel perforation score 32. Tear-away strips 36 and 37 as used in the present invention may include perforated strips, zipper rules, or other methods for detaching attached elements. Optionally, glue areas may be incorporated to further attach the front cover panel 12 to a punch-out portion 40. The embodiment of FIG. 4 may be altered by providing a side cover attachment flap 46 without a side tear-away strip 37. In this embodiment, the front cover panel 12 may be torn, cut off, or otherwise destructively detached without the need for a tear strip.

Figure 5:
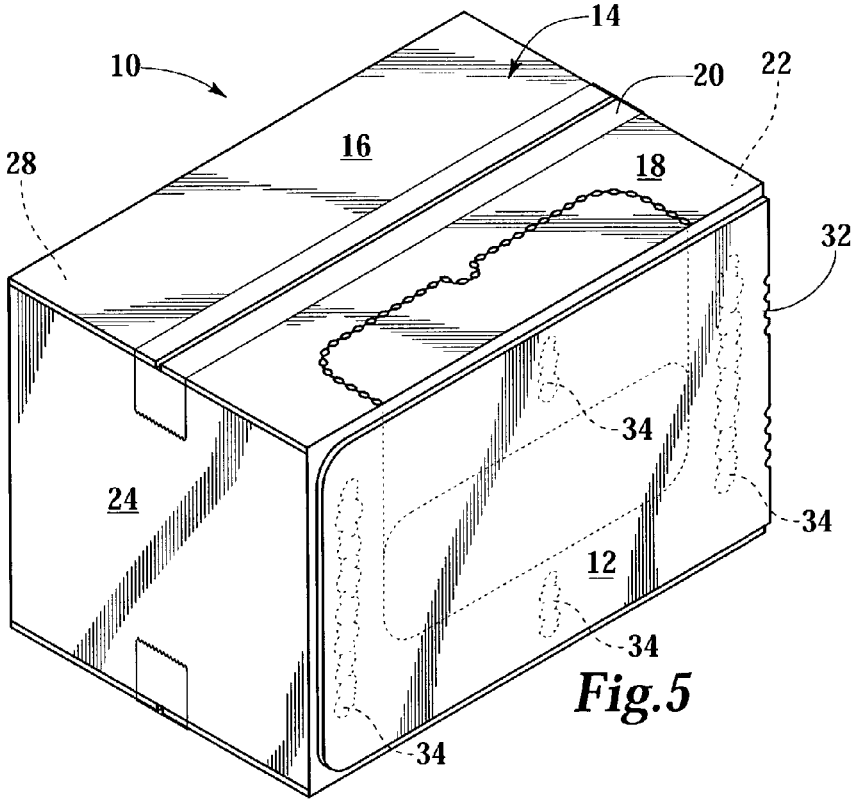
FIG. 5 is an isometric view of a shipping and display container according to another embodiment of the present invention.

FIG. 5 shows another means of attaching the front cover panel 12 to a container, using adhesive. In this embodiment, one or more adhesive areas 34 are used to attach the front cover panel 12 to the front panel 26 or to a punch-out portion 40.

Other alternative methods may be used for attaching a front cover panel 12 to the front panel 26. For example, as shown in FIG. 5, adhesive may be placed in multiple adhesive areas 34 between the front panel 26 and the front cover panel 12. It is preferred in this embodiment to use adhesives with some releasable properties, which may be referred to as "fugitive glues." Adhesives which withstand the high impact short duration shocks typical in the distribution system but which release under gradual and constant force are useful in this embodiment. If the container 10 is made of corrugated paperboard, it is preferred to use an adhesive which will release with little or no fiber tear. It is to be understood that this method of attachment may be combined with other methods for attaching the front cover panel 12. Further, less-releasable adhesives may be used in areas of a container where fiber tear can be tolerated.

A front cover panel 12 according to the present invention provides containment and protection of products within the container 10 during distribution but is easily and cleanly removable to provide retail display features. According to one embodiment of the present invention, the front panel 26 contains graphics or text, such as advertisements or information about the product in the container 10, which are protected by the front cover panel 12. Further, the front cover panel 12 may itself be printed with graphics or text for use during shipment—for example, shipping instructions or information about placement of the item within a store—which are removed along with the front cover panel 12 for display of the container 10.

While it is preferred to manufacture a container 10 according to the present invention using corrugated paperboard, preferably with corrugations running in a vertical direction for increased stacking strength, it is to be understood that the principles of this invention could be applied to containers made of other materials, such as non-corrugated paperboard, cardboard, and corrugated or uncorrugated plastic materials.

Figure 6:
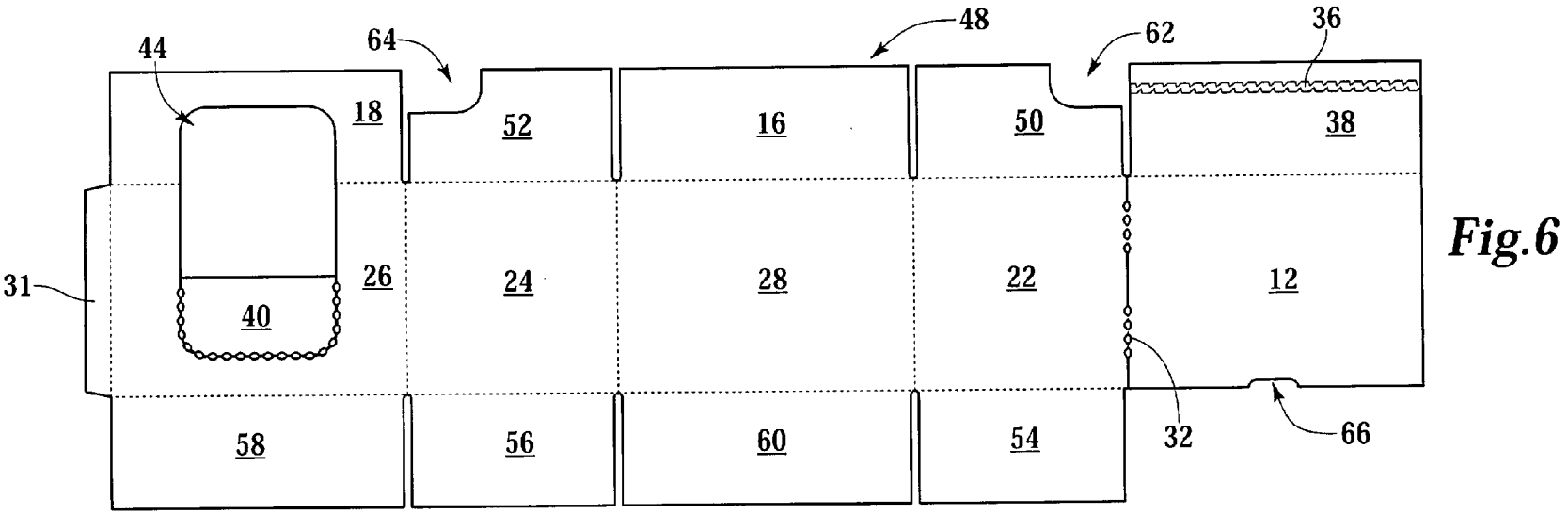
FIG. 6 is a plan view of the inner surface of a blank for forming the stackable, displayable produce container of FIG. 1.

Turning now to FIG. 6, a plan view of a blank 48 for the formation of a container 10 is shown. In addition to the panels and flaps illustrated in FIG. 1, the blank 48 includes first and second inner top flaps 50 and 52, respectively connected along fold lines to first and second side panels 22 and 24. Also connected respectively along fold lines to first and second side panels 22 and 24 are first and second inner bottom flaps 54 and 56. First and second outer bottom flaps 58 and 60 are connected along fold lines to the front panel 26 and the back panel 28, respectively. The access opening 44 is shown extending from the front panel 26 upwardly to the second outer top flap 18, though it is to be understood that the access opening 44 could be enlarged or shrunk from the size shown in FIG. 6, and further may be contained solely within the front panel 26 or within the second outer top flap 18 depending on the specific application for the container 10. When the access hole 44 is to extend to the top of the container 10, cutaway portions 62 and 64 are provided on the first and second inner top flaps 50 and 52. Alternatively, the first and second inner top flaps 50 and 52 could be cut shorter to accommodate an access hole 44 extending to the top of the container 10. A front cover panel handle cutaway 66 may be provided for ease of removing the front cover panel 12.

To construct a container 10 from the blank 48, the panels are folded along the fold lines so that the manufacturing tab 31 lays against the edge of the first side panel 22 closest to the cover panel perforation score 32. The manufacturing tab 31 is attached to this edge. Next, the bottom inner flaps 54 and 56 are folded inwardly and the bottom outer flaps 58 and 60 are folded inwardly and affixed in a closed position. At this point, the front cover panel 12 may be folded toward the front panel 26 and affixed in position covering the front panel 26. The container is filled, and the top inner flaps 50 and 52 are folded inwardly, followed by the top outer flaps 16 and 18. Finally, the top portion 38 of the front cover panel is folded inwardly and the top of the container 10 is affixed in a closed position. According to one embodiment of the present invention, the cover panel perforation score 32 breaks during construction such that the front cover panel 12 is attached to the container 10 with adhesive areas 34. For many applications, it is not necessary that the perforation score 32 remain intact during construction or distribution of the container 10.

According to another embodiment of the present invention, a blank 48 without a second outer top flap 18 is used to form a container. In such an embodiment, the top portion 38 of the front cover panel 12 may be adhered to the first outer top flap 16 or to the inner top flaps 50 and 52 in order to effect closure of the container. In this embodiment, the top portion 38 of the front cover panel 12 provides protection of container contents during shipping and storage. Another alternative configuration for a blank 68, shown in FIG. 7, includes a punch-out portion 70 and omits any top portion 38 for the front cover panel 12. In a container built from this blank the punch-out portion 70 protects the container contents from above. In this embodiment, adhesive areas 34 are used to affix the front cover panel 12 in a closed position.

Figure 8:
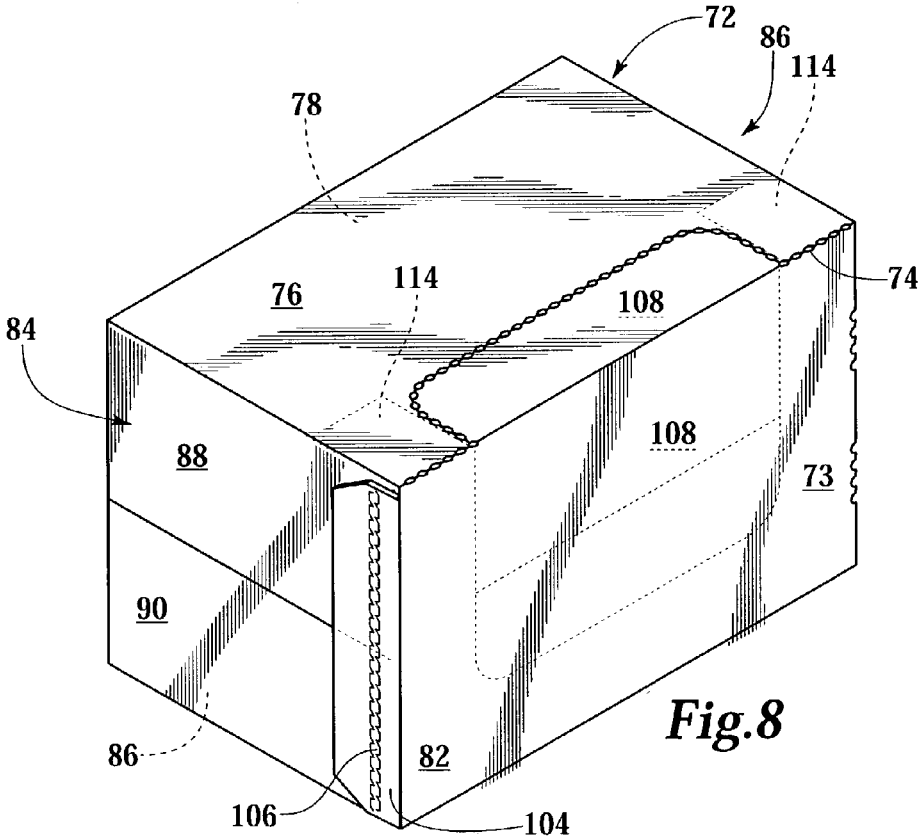
FIG. 8 is an isometric view of an alternative embodiment of a container according to the present invention.

Turning now to FIG. 8, another alternative embodiment of a container 72 according to the present invention is shown. The container 72 is an "end load" container having a front cover panel 73. The front cover panel 73 of the container 72 is shown depending from a front cover perforation score 74 along the upper edge of the front cover panel 73, though it is to be understood that the container 72 could be constructed such that the front cover perforation score 72 extends along a bottom edge of the front cover panel 73. As discussed above, the front cover perforation score 72 can be designed such that during construction of the container 72 from a blank, the front cover perforation score 72 breaks, or the front cover perforation score 72 may remain intact until purposely broken by a user for display of the container 72.

The container 72 is comprised of a top panel 76, a back panel 78, a bottom panel 80, and a front panel 82. The container 72 further has first and second sides, 84 and 86. The first side 84 is comprised of first and second outer first side flaps 88 and 90 and first and second inner first side flaps 92 and 94. The second side is comprised of first and second outer second side flaps 96 and 98 and first and second inner second side flaps 100 and 102. Flaps that are not visible due to perspective in FIG. 8 are visible in the plan view of FIG. 9.

To more securely fasten the front cover panel 73 to the container 72, the front cover panel 73 may be affixed to the first side 84, to the second side 86, or to both the first and second sides 84 and 86 using one or more front cover panel side flaps 104. The front cover panel side flaps 104 can be affixed to container sides using adhesive areas 105 shown in FIG. 9 Alternatively, tape, staples, or other types of fasteners may be used for attaching the side flaps 104 to the container sides. Further, one or both of the front cover panel side flaps 104 may be provided with a side flap tear strip 106. Further, as discussed above, the front cover panel 73 may be attached to the front cover 82 via adhesive areas in lieu of or in addition to the use of the front cover side flap 104.

In use, the container 72 may be converted from a distribution configuration to a display configuration by removing the front cover panel 73, and exposing an access opening 108. The access opening may be formed solely via an opening in the front panel 82, or by a combination of an opening in the front panel 82 and an opening in the top panel 76 formed by removing a top punch-out portion along a punch-out perforation line 110.

Figure 9:
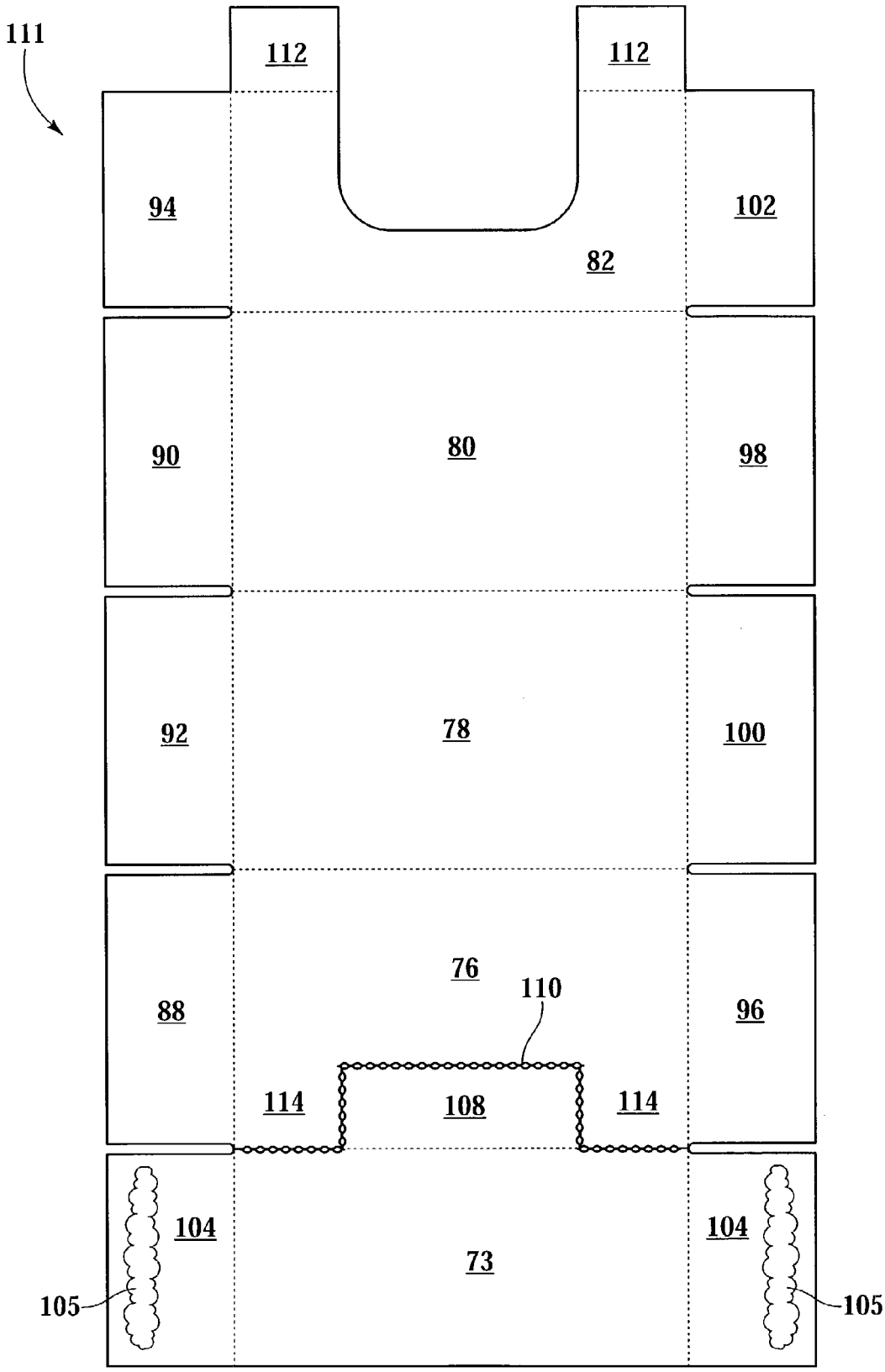
FIG. 9 is a plan view of a blank for forming a container according to one embodiment of the present invention.

Turning now to FIG. 9, a blank 111 suitable for forming the container 72 of FIG. 8 is shown. To construct the container 72, construction flaps 112 are connected to the top panel 76 at construction flap connection areas 114, thereby forming a rectangular box with open ends. Next, the first and second inner second side flaps 100 and 102 may be folded inwardly and the first and second outer second side flaps 96 and 98 may be folded over the inner side flaps and affixed to prevent them from opening. Alternatively, the first side flaps may be folded in first.

Next, the front cover panel 73 may be folded over the front panel 82 and affixed to the front panel 82 using adhesive areas if desired. The container 72 may then be filled, and to enclose the contents the first and second inner first side flaps 92 and 94 and the first and second outer first side flaps 88 and 90 may be folded inwardly and affixed closed. If two front cover panel side flaps 104 are employed, the front cover panel side flaps 104 may then be folded toward the first and second sides 84 and 86 of the container 72 and affixed thereto.

In constructing a container according to some embodiments of the present invention, it is preferred to provide a partially pre-formed, flattened container in which a front cover panel partially or completely covers a front panel. For example, referring to FIG. 6, the panels may be folded inwardly such that the manufacturing tab 31 is attached to the first side panel 22 and the front cover panel 12 may be folded over the front panel 26 and affixed in an appropriate manner prior to folding any of the inner or outer top or bottom flaps. Thus, a flattened and more compact ready-to-assemble blank (or "knock-down" blank) may be provided at a location where a container is to be built, filled, and closed for distribution.

It is to be understood that various combinations of features of the illustrated embodiments can be combined into containers for specific applications. For example, both a top portion 38 of a front cover panel 12 and a punch-out portion 70 covering an access opening 44 may be incorporated into a single container design. Further, the present invention enables the provision of a front cover panel along with the placement of perforations, tear strips, and releasable glues in positions where they are reinforced by support structures in close proximity. For example, referring to FIG. 1, the tear-away strip 36 is located above the second outer top flap 18. This makes it more difficult to inadvertently rupture the tear-away strip 36 and further, if the tear-away strip 36 were to inadvertently rupture, the contents of the container 10 would still be protected by the second outer top flap 18, and by inner flaps beneath that. A similar approach can be seen with respect to the cover panel perforation score 32 of FIG. 1.

Figure 10:
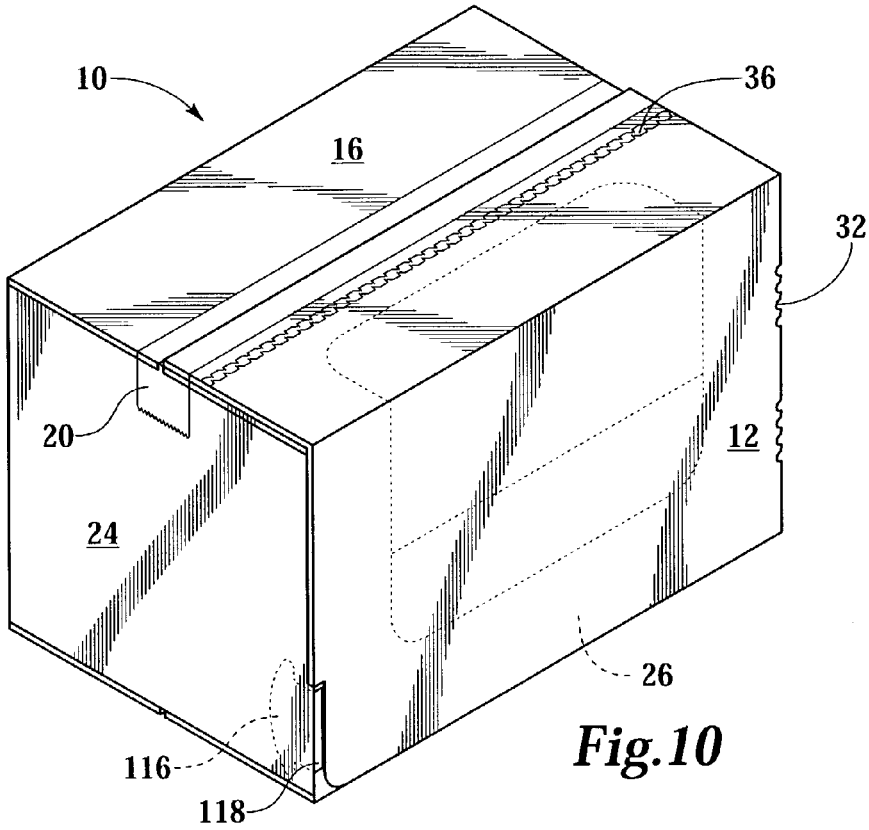
FIG. 10 is an isometric view of a container according to one embodiment of the present invention.

Alternative attachment methods may be used for attaching a front cover panel 12 of the present invention. For example, as shown in FIG. 10, a tab 116 may extend from the front cover panel 12 for insertion into a slot 118. Such a tab may be provided along a top, bottom, or side edge of the front cover panel 12 with a slot provided at a corresponding location of the front panel 26.

Figure 11:
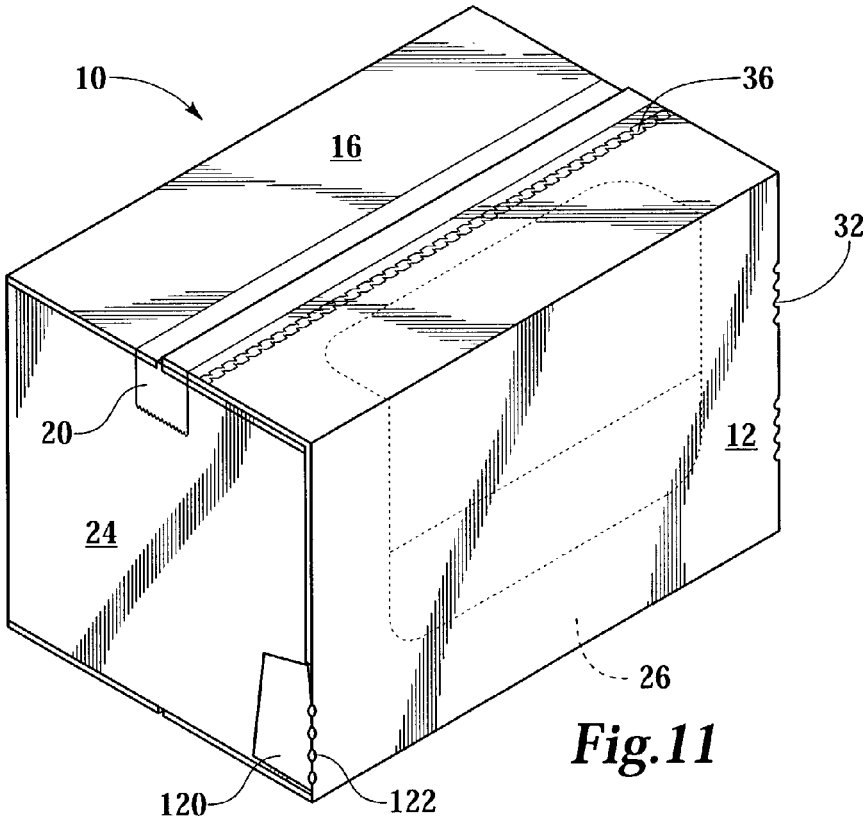
FIG. 11 is an isometric view of a container according to one embodiment of the present invention.

Further, as shown in FIG. 11, a partial attachment flap 120 may be attached to the front panel along a partial flap score 122. In this embodiment, the partial attachment flap 120 may be machine-glued or otherwise attached to a side or bottom panel of the container to increase the strength with which the front cover panel 12 is attached to the container. The partial flap score 122 may be partially or entirely perforated, or it may be provided intact, allowing for destructive removal of the front cover panel 12 by tearing or slitting.

Other means may be used to attach the front panel 12 to the container. For example, in addition to or instead of the top portion 38 of the front cover panel 12 as shown in FIG. 1, a portion of the front cover panel 12 may extend around the bottom of the container 10 along a score line, which may be perforated or unperforated.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A container comprising:

a bottom;

a top opposing said bottom;

first and second side panels bridging said top and said bottom;

a back panel bridging said top and said bottom; and a front panel bridging said top and said bottom, said front panel having an access opening provided therein, said access opening covered by a front cover panel having a front portion and a top portion, said top portion of said front cover panel having a top tear-away strip for removing said top portion of said front cover panel from said top of said container, said front cover panel being attached to said container along a first side edge of said front portion along a perforated score line.

2. A container comprising:

a bottom;

a top opposing said bottom;

first and second side panels bridging said top and said bottom;

a back panel bridging said top and said bottom; and a front panel bridging said top and said bottom, said front panel having an access opening provided therein, said access opening covered by a front cover panel having a front portion and a top portion, said top portion of said front cover panel having a top tear-away strip for removing said top portion of said front cover panel from said top of said container, said access opening being partially covered by a punch-out portion attached to said front panel along at least one perforation line and further attached to said front cover panel via at least one adhesive area.

3. A container comprising:

a first side panel;

a back panel connected to said first side panel;

a second side panel connected to said back panel;

a front panel connected to said second side panel, said front panel having a manufacturing tab attached thereto, said manufacturing tab being connected to said first side panel;

a first inner top flap extending inwardly toward a center of said container at approximately a right angle from said first side panel;

a second inner top flap extending inwardly toward the center of said container at approximately a right angle from said second side panel;

a first outer top flap extending inwardly along the top of said container at approximately a right angle from said back panel;

a second outer top flap extending inwardly along the top of said container at approximately a right angle from said front panel; and a front cover panel covering at least a portion of said front panel, said front cover panel being attached to said first side panel along a front cover panel side attachment line, said front cover panel comprising a front portion and a top portion, said top portion of said front cover panel partially overlying said second outer top flap and being bordered along one edge by a top tear-away strip.

4. The container of claim 3 wherein said front cover panel side attachment line is a perforated attachment line.

5. The container of claim 3 wherein said front cover panel is further attached to said second side panel via a side cover attachment flap.

6. The container of claim 3 wherein said front cover panel side attachment line comprises perforated portions and open portions.

7. The container of claim 5 wherein said front cover panel is attached to said side cover attachment flap along a removable side tear strip.

8. The container of claim 3 wherein said front panel is provided with a front panel access opening therein, said access opening being at least partially covered by a punch-out portion attached to said front panel along a perforated punch-out path.

9. The container of claim 8 wherein said punch-out portion is attached to said front cover panel at one or more adhesive areas.

10. The container of claim 8 wherein said second outer top flap is provided with a top flap access opening therein, said front panel access opening and said top panel access opening being exposed upon removal of said front cover panel.

11. The container of claim 3 wherein said front cover panel is attached to said second side panel by a partial flap, said partial flap being attached to said front cover panel along a partial flap score line.

12. The container of claim 3 wherein said front cover panel is attached to said front panel via a releasable adhesive.

* * * * *